United States Patent [19]

Hultberg

[11] Patent Number: 5,038,681

[45] Date of Patent: Aug. 13, 1991

[54] CONTROL METHOD AND APPARATUS FOR SPRAY DAMPENER

[75] Inventor: Sten Hultberg, Löddeköping; Birger Hansson, Akarp, both of Sweden

[73] Assignee: Jimek International AB, Malmo, Sweden

[21] Appl. No.: 553,350

[22] Filed: Jul. 17, 1990

Related U.S. Application Data

[63] Continuation of Ser. No. 145,323, Jan. 19, 1988, abandoned.

[51] Int. Cl.[5] ..... B41F 7/30; B41F 33/16; B41L 25/06

[52] U.S. Cl. ..... 101/484; 101/148

[58] Field of Search ..... 101/147, 148, 366, 365, 101/207, 208–210, DIG. 45, 484, 483

[56] References Cited

U.S. PATENT DOCUMENTS

| | | | |
|---|---|---|---|
| 3,924,531 | 12/1975 | Klingler | 101/147 |
| 3,926,115 | 12/1975 | Alsop | 101/148 |
| 4,064,801 | 12/1977 | Switall | 101/147 |
| 4,151,796 | 5/1979 | Uhrig . | |
| 4,200,932 | 4/1980 | Schramm et al. . | |
| 4,281,380 | 7/1981 | DeMesa, III et al. . | |
| 4,469,024 | 9/1984 | Schwartz | 101/147 |
| 4,570,538 | 2/1986 | Webb | 101/366 |
| 4,639,881 | 1/1987 | Zingher . | |
| 4,649,818 | 3/1987 | Switall | 101/147 |
| 4,667,323 | 5/1987 | Engdahl et al. . | |
| 4,708,058 | 11/1987 | Smith . | |
| 4,797,686 | 1/1989 | Holder | 118/674 |
| 4,815,375 | 3/1989 | Switall et al. . | |
| 4,867,063 | 9/1989 | Baker et al. . | |
| 4,892,035 | 1/1990 | Terzuolo . | |
| 4,899,653 | 2/1990 | Michl et al. . | |

FOREIGN PATENT DOCUMENTS

| | | | |
|---|---|---|---|
| 587039 | 10/1933 | Fed. Rep. of Germany | 101/366 |
| 947612 | 8/1956 | Fed. Rep. of Germany | 101/147 |
| 1404808 | 9/1975 | United Kingdom | 101/147 |

*Primary Examiner*—J. Reed Fisher

*Attorney, Agent, or Firm*—Burns, Doane, Swecker & Mathis

[57] ABSTRACT

A pulsed spray dampener system wherein, during low press speeds, nozzles are controlled to release pulses of dampening fluid having a fixed pulse width and fluid output is adjusted by varying the interval between dampener pulses. During high speed operation, the interval between pulses is fixed and pulse width is varied. Furthermore, the outermost nozzles of a spray bar are operated by dedicated control channels to permit better spray patterns.

29 Claims, 6 Drawing Sheets

Fig. 8
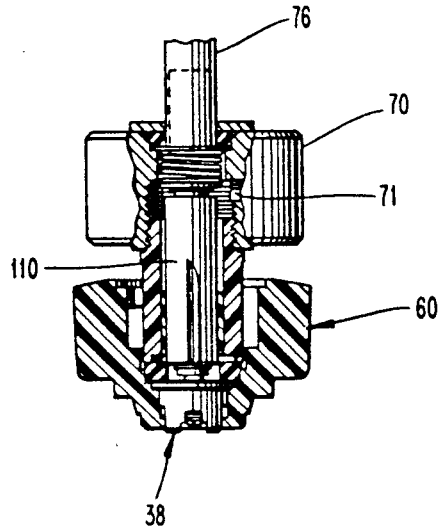
Fig. 10
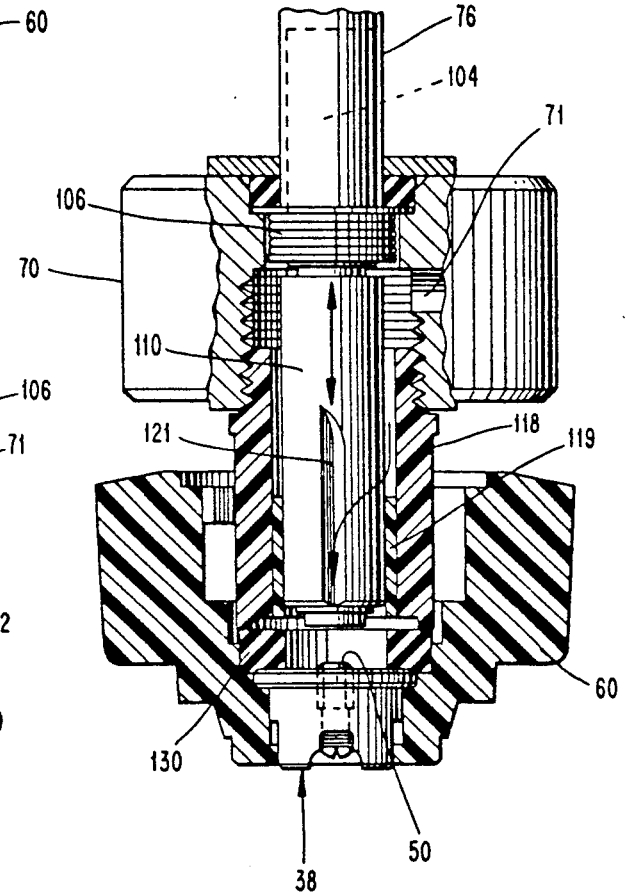
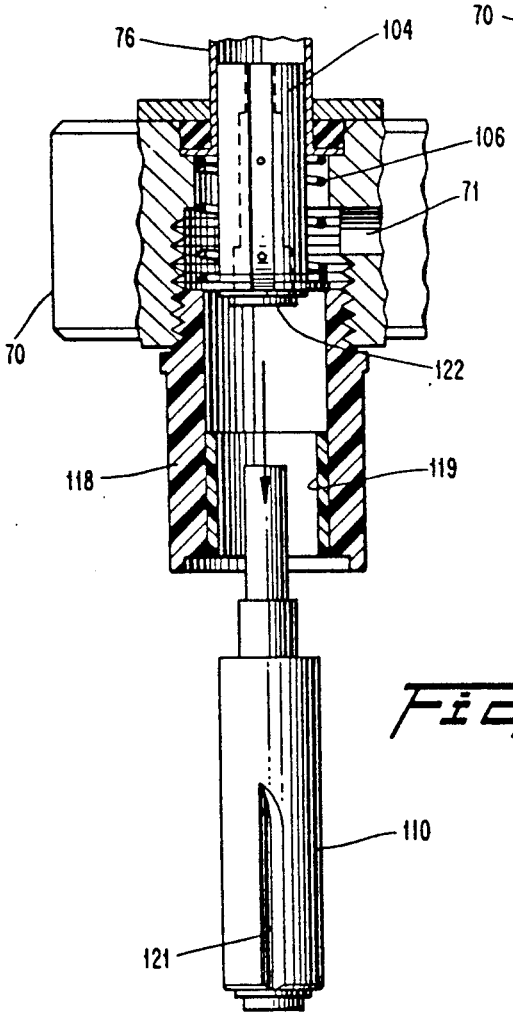
Fig. 9

CONTROL METHOD AND APPARATUS FOR SPRAY DAMPENER

This application is a continuation of application Ser. No. 07/145,323, filed Jan. 19, 1988, now abandoned.

BACKGROUND OF THE INVENTION

The present invention relates to a spray dampening system. More particularly, the present invention relates to a control technique for the spray bar of a pulsed spray dampener.

Various systems have been proposed in the past for applying a fluid to the rollers of printing presses. These fluids may be used, for example, for dampening or cleaning the rollers, or for preventing printing offset. One type system dampens the rollers by spraying a fluid mist from nozzles positioned adjacent the rollers. Typically, a plurality of nozzles are aligned in a spray bar. It is often desirable to vary the spray output of a spray dampener in response to certain operating parameters such as press speed and printing density.

U.S. Pat. No. 4,469,024 to Schwartz et al relates to a pulsed spray dampener is dispensed is controlled by a measured press speed. In the disclosed embodiment, a speed sensor generates a sinusoidal sensor signal having a frequency related to the press speed. A pulse width modulator receives the sinusoidal sensor signal and generates a square wave control signal wherein the pulse duration is maintained constant. The time between pulses in the square wave control signal is varied as a function of press speed. The control signal is converted to pneumatic pulses used operate air-actuated valves which supply fluid to the spray nozzles.

Another spray dampener system is disclosed in U.S. Pat. No 4,649,818 to Switall et al. A speed sensor provides a sensor signal to a master controller which, on the basis of the sensor signal value, selects one of a plurality of oscillating electrical signals having discrete frequencies. The selected frequency signal is supplied to a monostable which produces a fixed-length pulse in response to the leading edge of each cycle of the frequency signal. The monostable pulses are then used to operate spray nozzle solenoids. The width of the monostable pulse may be adjusted manually.

U.S. Pat. No. 3,926,115 to Alsop discloses a spray dampening apparatus wherein the fluid output may be temporarily varied by partial or complete interruption of the spray. A solid obstructor may be placed in the spray path or a deflecting air blast may be used to vary the spray output. In the spray dampener disclosed in U.S. Pat. No. 3,924,531 to Klinger, the output spray may be controlled by varying the position of various mechanical members.

All of the known spray dampeners have had several drawbacks. For example, pulsed spray dampeners often encounter difficulties which lead to poor spray patterns and the like. In a system wherein the amount of dampening fluid is varied by changing the "ON" time of the spray nozzles, control of the dampening fluid output during low speed press operation is restricted by physical limitations in the spray nozzles, valves, and the like. Additionally, in systems wherein the "OFF" time of the spray nozzles is controlled, the controller is limited by the possibility of drying when there are long periods of time between spray pulses. Systems using a physical technique to vary spray output encounter difficulties in obtaining a proper spray pattern. Accordingly, there exists a need for a spray dampening system which overcomes the difficulties confronted in earlier spray dampening systems.

OBJECTS AND BRIEF SUMMARY OF THE INVENTION

It is a primary object of the present invention to provide a spray dampening system which easily and effectively adjusts to changes in operating parameters.

It is a further object of the present invention to provide a spray dampening system having an improved spray pattern.

A more specific object of the present invention is to provide an improved pulse spray dampening system for wetting a printing press roller wherein the amount of dampening fluid sprayed on the roller is varied in accordance with the speed of the printing press and a programmed dampening curve.

These and other objects are obtained in the present invention by providing a spray dampener control system including means for sensing the printing press speed. In response to the sensed press speed, a rectangular pulse sequence is generated. When the sensed press speed is below a particular value, each pulse in the rectangular pulse sequence has a fixed duration and the time period between adjacent pulses is varied in response to the press speed. When the press speed is above the particular value, the time period between adjacent pulses is fixed and the duration of the pulses is varied in response to the sensed speed. Spray nozzles are driven in response to the rectangular pulse sequence.

BRIEF DESCRIPTION OF THE DRAWINGS

The objects and advantages of the invention will become apparent from the following detailed description of preferred embodiments thereof in connection with the accompanying drawings, in which like numerals designate like elements, and in which:

FIG. 8 is a fragmentary longitudinal sectional view taken through the sprayer assembly when the nozzle section is closed by the valve stem;

FIG. 9 is a fragmentary exploded longitudinal sectional view taken through a valve section of the sprayer assembly depicting the valve stem being removed from the plunger;

FIG. 10 is a view similar to FIG. 8 with the valve stem in a retracted position to emit fluid flow to the nozzle;

DETAILED DESCRIPTION OF PREFERRED EMBODIMENTS OF THE INVENTION

Figure 1:
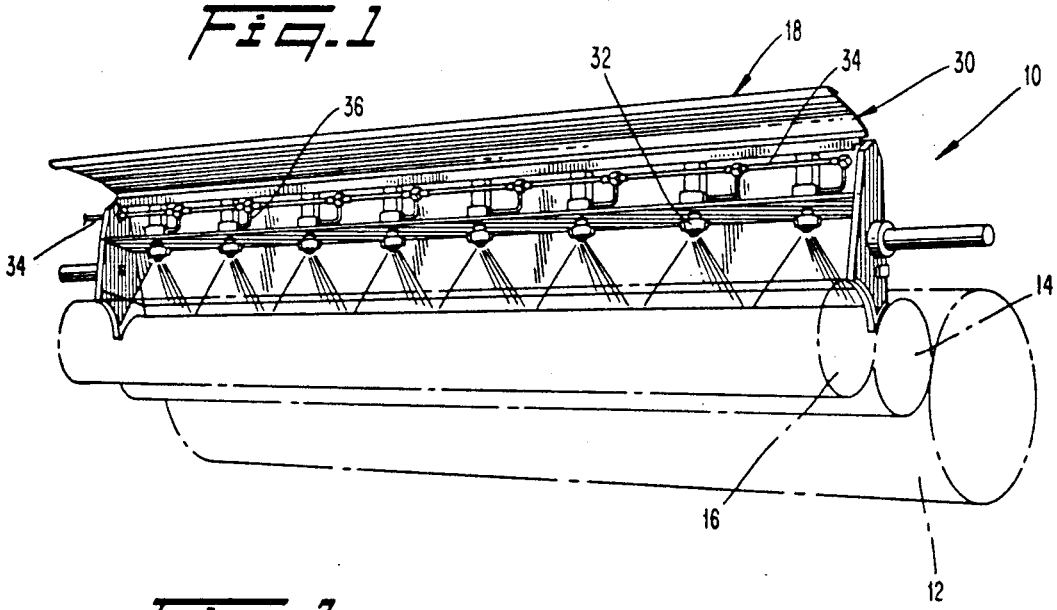
FIG. 1 is a perspective view of a spray mechanism according to the present invention, with portions of a printing mechanism depicted in phantom.
Figure 2:
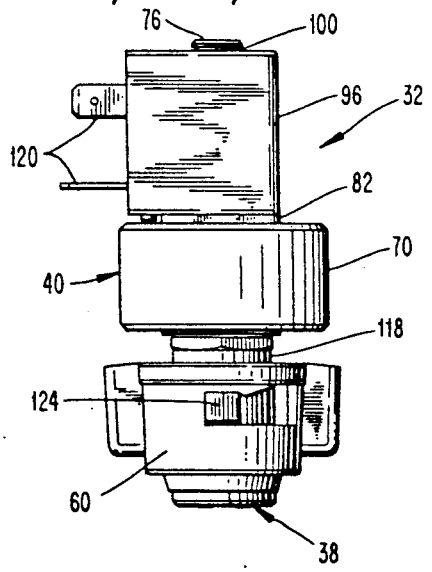
FIG. 2 is a side elevational view of a sprayer assembly according to the present invention.
Figure 3:
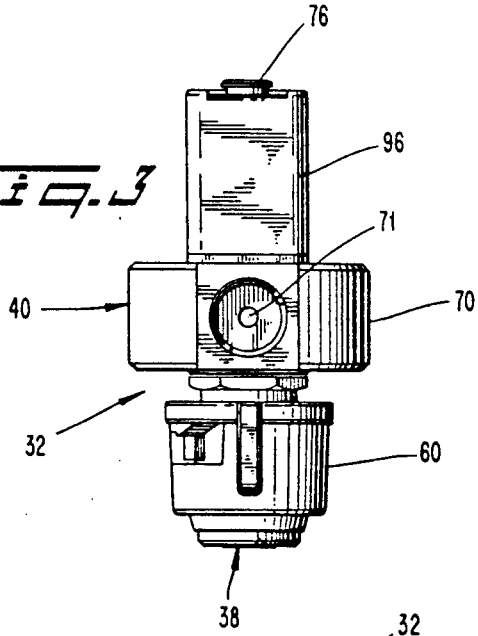
FIG. 3 is a view similar to FIG. 2 displaced ninety degrees therefrom.
Figure 4:
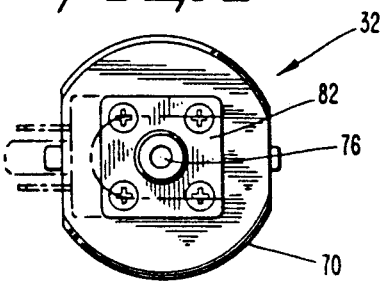
FIG. 4 is a rear end view of the sprayer assembly, with a solenoid casing thereof depicted in phantom lines.
Figure 5:
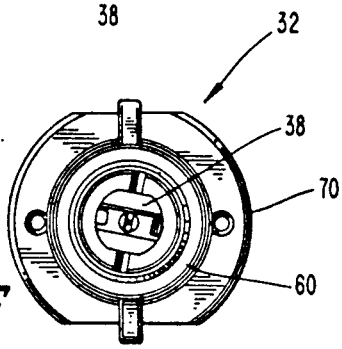
FIG. 5 is a front end view of the sprayer assembly.

Depicted in FIG. 1 is a portion of an offset printing apparatus 10 comprising a plate cylinder 12, a water form roll 14, a dampening roll 16, and a spray dampener mechanism 18. The spray dampener mechanism 18 emits a pulsating spray of wetting liquid, such as water which may contain certain additives, the liquid being sprayed onto the dampener roll and from there transferred to the water form roll.

The dampener mechanism comprises a housing 30 upon which are mounted a plurality of sprayer assemblies 32. Those sprayer assemblies 32 are connected in parallel with a fluid inlet conduit 34 for receiving pressurized wetting liquid by means of separate take-off lines 36 leading from the inlet conduit 34 to the respective nozzle assemblies 36.

Figure 7:
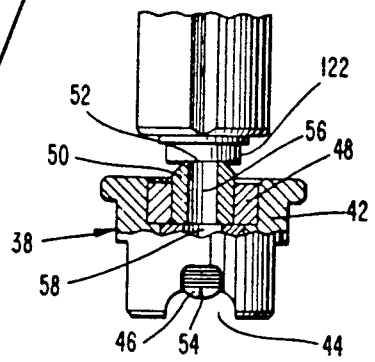
FIG. 7 is a fragmentary view of a nozzle section being sealingly engaged by a valve stem, with portions of the nozzle section being broken away.

Each sprayer assembly 32 comprises a nozzle section 38 and a valve section 40. The nozzle section 38 comprises a generally cylindrical nozzle housing 42 (FIG. 7) which includes a transverse slot 44 at its front end. Mounted by press-fit within a center bore of the nozzle housing 42 is a nozzle element 46, preferably formed of hard, wear-resistant material such as tungsten carbide. Press-fit into a rear end of the center bore is a retaining ring 48, and press-fit into a center hole of the ring 48 is a valve seat 50. The valve seat is of generally hollow cylindrical shape and includes a tapered end 52. The nozzle element 46 includes a slit 54 in its front end, which slit communicates with a center passage 56 of the valve seat 50 through a center passage 58 in the nozzle element 46.

Figure 6:
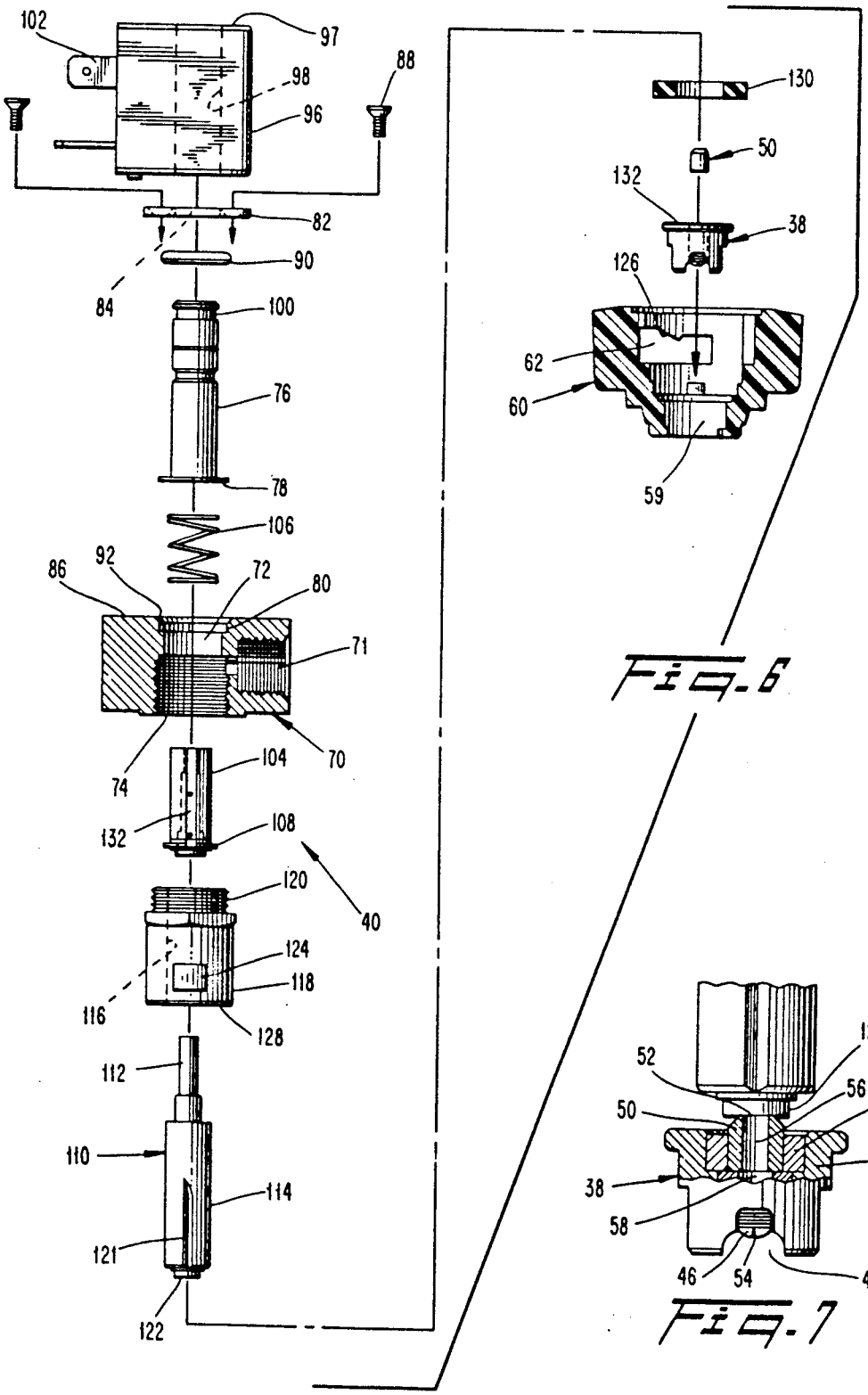
FIG. 6 is an exploded longitudinal sectional view of the sprayer assembly.

The nozzle housing 42 is removably disposed in the front end of a throughbore 59 formed in a cap 60 (FIG. 6) of the type described in U.S. Pat. No. 4,527,745. The cap 60 includes slots 62 in its outer wall for reasons to be explained hereinafter.

The valve section 40 (FIG. 6) comprises a valve housing 70 which includes a through-bore 72, a front end of which containing an internal thread 74. A liquid, such as a dampening solution, is supplied to the valve housing 70 by means of a port 71 which may be threaded to receive a correspondingly threaded conduit. Removably attached to a rear end of the valve housing is a hollow post 76. The post 76 includes an enlarged flange 78 at its front end which fits into a counterbore 80 located at a rear end of the throughbore 72. A plate 82 has a central opening 84 through which the post 76 passes, the plate 82 being attached to the rear side 86 of the valve housing 70 by means of screws 88. A resilient seal ring 90 is disposed between the plate 82 and the flange 78 to engage a flared rear end 92 of the counterbore 80 in order to create a fluid seal therewith.

Mounted on a rear end of the post 76 is a conventional plug-in type solenoid coil casing 96. That casing includes a bore 98 through which the post 76 extends. An annular external groove 100 is formed at the rear end of the post 76 to receive a retaining ring (not shown) or the like for retaining the casing 96 on the post. A spring (not shown) may be disposed between such retaining ring and a rear surface 97 of the casing to bias the casing against the plate 82. The spring would be yieldable to permit the casing to be displaced slightly away from the plate 82 in order to be rotated about the axis of the post 76 so that the three plug-in prongs 102 could be repositioned.

The post 76 has a hollow front end into which a valve plunger 104 is slidably disposed so as to be positioned within the solenoid coil casing 96. The plunger is adapted to be displaced rearwardly (i.e., upwardly as viewed in FIG. 6) in response to energization of the solenoid coil contained within the casing 96. A coil compression spring 106 surrounds the plunger 104 and acts between the flange 78 and a flange 108 situated at a front end of the plunger 104. The flange 108 may be formed by a split retaining ring for example. Thus, when the plunger is retracted rearwardly by the solenoid coil, the spring 106 is compressed.

Removably mounted in a front hollow end of the plunger is a valve stem 110. The valve stem 110 includes a rear portion 112 mounted by friction-fit within the plunger 104, and a front portion 114 of enlarged cross-section which slides within a throughbore 116 of a body member 118. The body member includes external threading 120 on its rear end which is screwed into the internal threading 74 of the valve housing. The body member 118 includes an internal bushing 119 within which a front end of the valve stem 110 slides. The valve stem includes a plurality of longitudinal channels 121 in its outer periphery for conducting liquid forwardly past the bushing 119 (see FIG. 10).

Projecting from the front end of the stem 110 is a disc 122 formed of a resilient material. The disc 122 is of larger diameter than the rear end of the passage 56 formed in the valve seat 50 and is adapted to bear sealingly thereagainst under the bias of the spring 106. It will be appreciated that the passages 56, 58, the stem 114, the plunger 104, and the post 76 are aligned along a common longitudinal axis.

The stem 114 is no larger in cross-section than the throughbore 116 of the body 118, whereby the stem 114 can be pulled out of the plunger 104 and completely out of the sprayer assembly 32 in a forward direction after the cap 60 and nozzle section 38 have been removed therefrom.

Attachment and removal of the nozzle section 38 is effected by the cap 60 in a conventional manner. That is, the slots 62 in the cap are arranged to receive radially projecting lugs 124 formed on the outer wall of the body 118. The side walls of the slots 62 include cam portions 126 which serve to draw the cap toward the body 118 in response to relative rotation therebetween. This causes the front wall 128 to be forced longitudinally against an elastic seal ring 130 positioned between the front wall 128 and a rear wall 132 of the nozzle housing 42. Counter-rotation of the cap is yieldably resisted by thus-compressed ring 130. The ring 130 also creates a fluid seal once it has been compressed in that fashion.

In operation, pressurized liquid is introduced to the sprayer assembly through the port 71. If the solenoid is de-energized, i.e., in a non-spraying mode, the valve stem is biased against the valve seat 50 to close the nozzle element. Once the solenoid has been actuated, the plunger and stem are retracted, thereby unblocking the valve seat. Pressurized liquid is immediately ejected through the valve outlet 54 and onto the roll. After the sealing disc 122 has become worn, removal thereof is achieved by simply unscrewing the body member 118 and pulling the stem 110 axially from the plunger. Insertion of a new stem is achieved by reversing those steps.

The present nozzle assembly offers significant advantages over a nozzle assembly previously employed in spray dampeners. Such a prior art nozzle assembly 236, depicted in FIGS. 11–13, comprises a nozzle section 238 and a valve section 240. The nozzle section 238 comprises a generally cylindrical nozzle housing 242 which includes a transverse slot 244 at its front end. Mounted by press-fit within a center bore of the nozzle housing 242 is a nozzle element 246, preferably formed of a hard, wear-resistant material such as tungsten carbide. Press-fit into a rear end of the center bore is a retaining ring 248. The nozzle element 246 includes a slit 254 in its front end, which slit communicates with a center passage 258 in the nozzle element 246. The nozzle housing 238 is removably disposed in the front end of a through-bore formed in a cap 260 (FIG. 12) of the type described in U.S. Pat. No. 4,527,745. The cap 260 includes slots 262 in its outer wall for reasons to be explained hereinafter.

The valve section 240 comprises a valve housing 270 which includes first and second threaded bores 271, 272 separated by a partition 273. The bores 271, 272 are aligned with each other and with the passage 258 in the nozzle housing 242. Disposed in the valve housing 270 perpendicularly to the bores 271, 272 is a third bore 274. That third bore 274 communicates with the first and second bores 271, 272 by first and second passages 275A, 275B, respectively. Removably attached to a rear end of the valve housing is a hollow post 276. The post 276 includes an enlarged flange 278 at its front end which fits into a counterbore 280 at a rear end of the third bore 274. A plate 282 has a central opening 284 through which the post 276 passes, the plate 282 being attached to the rear side 286 of the valve housing 270 by means of screws 288. A resilient seal ring 290 is disposed between the plate 282 and the flange 278 to engage a flared rear end 292 of the counterbore 280 in order to create a fluid seal therewith.

Mounted on a rear end of the post 276 is a conventional plug-in type solenoid coil casing 296. That casing includes a bore 298 through which the post 276 extends. An annular external groove 300 is formed at the rear end of the post 276 to receive a retaining ring (not shown) or the like for retaining the casing 296 on the post. A spring (not shown) may be disposed between such retaining ring and the rear side 297 of the casing to bias the casing against the plate 282. Such spring would be yieldable to permit the casing to be displaced slightly away from the plate 282 in order to be rotated about the axis of the post 276 so that the three plug-in prongs 302 could be repositioned.

The post 276 has a hollow front end into which a valve plunger 304 is slidably disposed so as to be positioned within the solenoid coil casing 296. The plunger is adapted to be displaced rearwardly (i.e., to the right in FIG. 12) in response to energization of the solenoid coil contained within the casing 296. A coil compression spring 306 surrounds the plunger 304 and acts against the flange 278 and a flange 308 situated at a front end of the plunger 304. The flange 308 may be formed by a split retaining ring for example. Thus, when the plunger is retracted rearwardly by the solenoid coil, the spring 308 is compressed to bias the plunger forwardly.

Disposed in a front end of the plunger 304 is an elastic sealing member 310 which is adapted to bear against a tapered seat 312 surrounding the passage 275A under the bias of the spring 306 whenever the solenoid coil is not energized. In so doing, the passage 275A will be closed, while the passage 275B will remain open.

The plunger 304 includes at least one longitudinal channel 314 which is adapted to conduct a flow of fluid from the passage 275B to the rear end of the hollow post 276. Such fluid would flow around an outer edge of the flange 308, though the channel 314 and through a small hole (not shown) at the rear of the post 276 and from there to a suitable conduit (not shown) connected to the rear end of the post 276.

Threadedly attached to the first bore 271 is a hollow body member 318 on which the nozzle housing 242 is to be mounted by means of the cap 260. In that regard, the slots 262 in the cap are arranged to receive radially projecting lugs 324 formed on the outer wall of the body 318. The side walls of the slots 262 include cam portions 326 which serve to draw the cap toward the body 318 in response to relative rotation therebetween. This causes a front wall of the body member 318 to be forced longitudinally against an elastic seal ring (not shown) positioned between the front wall and a rear wall of the nozzle housing 242.

Figure 11:
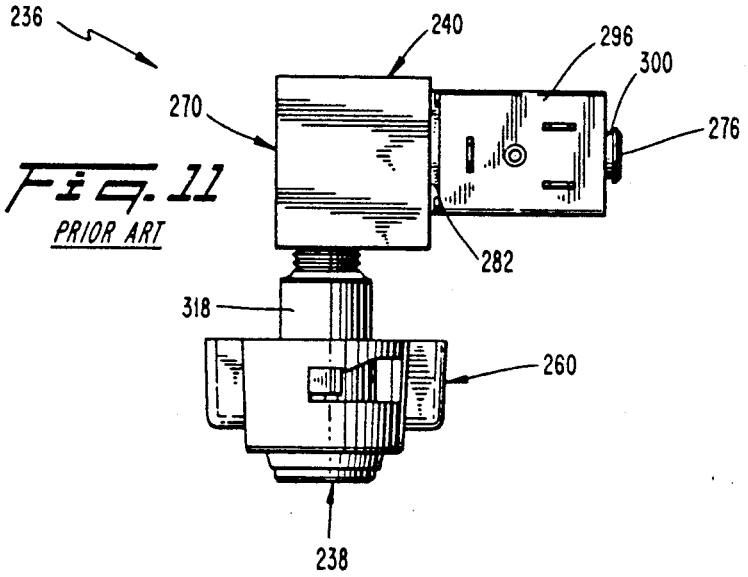
Fig. 11 PRIOR ART
FIG. 11 is a side elevational view of a prior art sprayer assembly.
Figure 12:
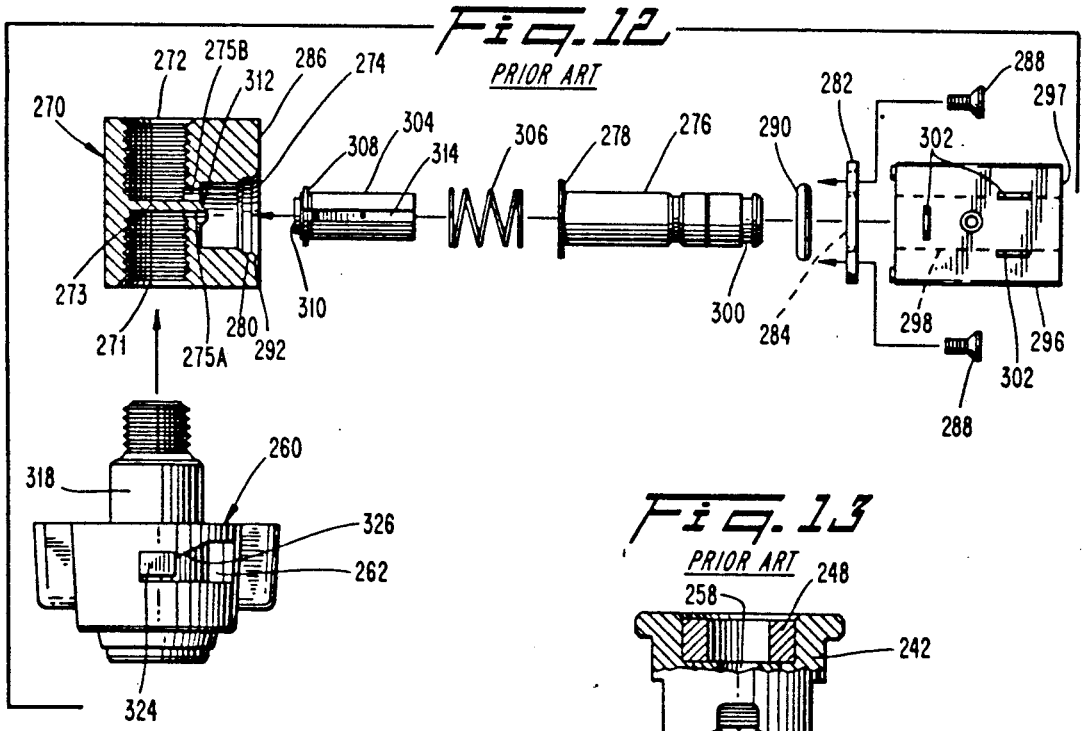
Fig. 12 PRIOR ART
FIG. 12 is an exploded view of the prior art sprayer assembly with portions thereof in longitudinal section.
Figure 13:
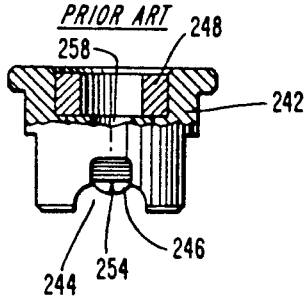
Fig. 13 PRIOR ART
FIG. 13 is a side elevational view, with portions broken away, of a prior art nozzle section.

In operation of the prior art apparatus disclosed in connection with FIGS. 11–13, pressurized fluid is delivered to the second bore 272 and flows through the passage 275B. If the solenoid is not energized, the valve plunger 304 closes the passage 275A, so that the fluid travels through the channel 314 and out the rear end of the post 276 to a suitable sump. If the valve is energized, causing the plunger 304 to be retracted, the passage 275A is opened, enabling fluid to flow therethrough and from there to the nozzle element. When the plunger is retracted, a seal at the wall 330 of the plunger engages the small hole (not shown) at a rear end of the plunger to close the flow to the sump. The cycle time $t_{TOT}$ is, of course, the sum of the ON time $t_{ON}$ and the OFF time $t_{OFF}$. Thus, the duty cycle D may be defined as $D = t_{ON}/t_{TOT} = (t_{ON} + t_{OFF})$.

Figure 14:
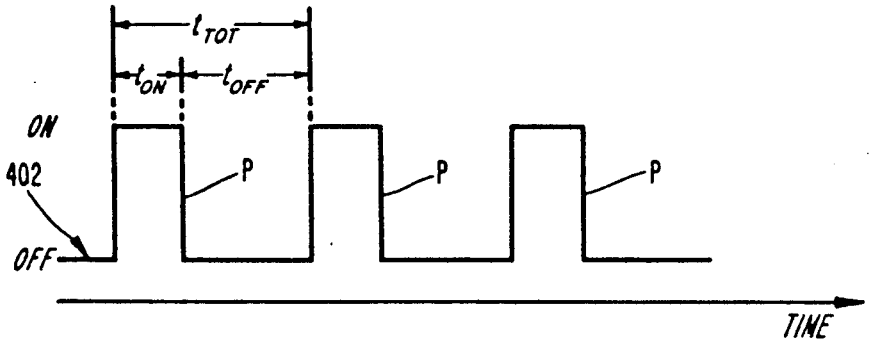
FIG. 14 illustrates a rectangular pulse sequence used for actuating a spray nozzle solenoid.

In order to adjust the spray output of the spray dampener, the duty cycle of the signal 402 may be varied. A higher duty cycle would increase the spray output from the dampener. For example, a duty cycle of 1 would mean that the signal 402 stayed in the ON position at all times and, thus, the spray nozzles would likewise remain ON at all times. The spray nozzles would remain in an OFF state for a duty cycle of 0. In the particular signal 402 illustrated in FIG. 14, the pulse width $t_{ON}$ is roughly one-third of the total cycle time $t_{TOT}$. Hence, the duty cycle for the illustrative signal 402 in FIG. 14 would be approximately 0.33, and a spray nozzle controlled by the signal would be ON roughly 33.3% of operating time.

The duty cycle may be varied by changing one or both of the pulse width $t_{ON}$ on the time $t_{OFF}$ between adjacent pulses of the pulse sequence defined by the signal 402. In a typical spray dampener, however, system limitations often prevent proper operation of the spray dampener beyond particular operating parameters. For instance, in systems which vary the duty cycle by varying the width of a pulse, valve and nozzle limitations prevent proper operation for pulse widths below a certain value. Thus, systems which vary ON time often suffer from poor spray patterns during periods in which spray output is low. Similarly, systems which vary the duty cycle by adjusting OFF time confront problems associated with roller drying when relatively long periods of time elapse between spray pulses, particularly during high speed press operation. The present invention, however, overcomes these difficulties.

Figure 15:
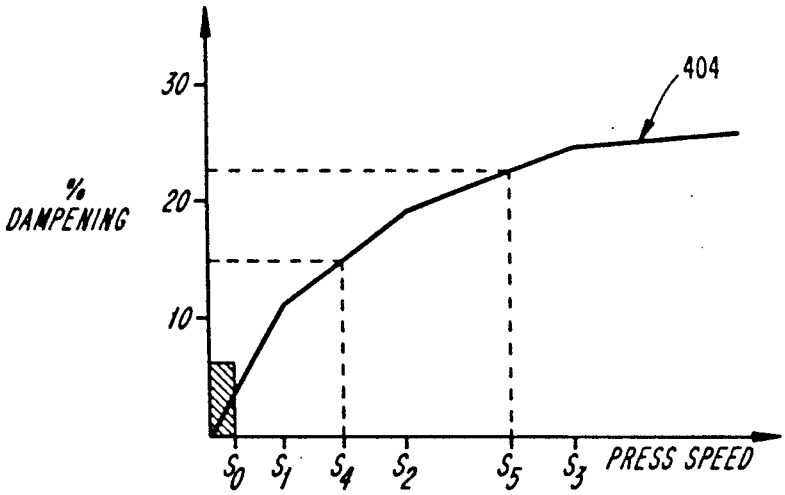
FIG. 15 illustrates a dampening curve for correlating press speed to spray nozzle operation parameters.

Referring to the dampening curve of FIG. 15, the amount of dampening fluid dispensed by the spray dampener preferably has a nonlinear relationship to press speed. At press speeds below a certain speed $S_0$, spray dampener output may be inhibited. This situation normally would occur as the press was being brought up to printing speed. As illustrated with dampening curve 404, between speed $S_0$ and speed $S_1$, the dampening percentage, i.e., the percentage of time during which the nozzles release dampening fluid, increases linearly with press speed at a first rate. Likewise, between press speeds $S_1$ and $S_2$, between press speeds $S_2$ and $S_3$, and above speed $S_3$, the dampening percentage varies linearly with press speed at different rates. If desired, the dampening curve may include a purge signal which would output when the printing press is initially brought to speed $s_0$. The speeds at which the dampening curve 404 encounters a change in slope, and the particular slopes for the individual segments of the dampening curve will depend on the printing press in which the spray dampening system is used.

In accordance with one feature of the present invention, when the press speed is below speed $S_2$, the pulse width $t_{ON}$ of nozzle control pulses P is set at a predetermined value, e.g., 20 microseconds, which is sufficiently long to ensure a proper spray pattern. The dampening percentage may then be varied by adjusting the time period between adjacent pulses in the pulse sequence. When the press speed is above speed $S_2$, the time period between adjacent pulses is set at a predetermined value, e.g., 400 microseconds, which ensures that the printing press rollers will not dry excessively between pulses of spray during high speed press operation. The dampening percentage is then varied by adjusting the pulse width of the pulses P. In this way, the present invention obtains proper spray patterns and effective operation throughout a broad range of operating conditions. Furthermore, due to the reltively long OFF times, the sprayer valves won't be actuated as often and thus will exhibit a longer life.

In another embodiment of the present invention, the pulse width between speeds $S_0$ and $S_1$, may be set at a first value, for example 20 microseconds, and the pulse width between speeds $S_1$ and $S_2$, when dampening requirements are higher, may be set at a higher second value such as 30 microseconds. Similarly, the time period between adjacent pulses of the pulse sequence for press speeds between speeds $S_2$ and $S_3$ may be set at one value, for example, 500 microseconds, and at another value such as 400 microseconds for press speeds above speed $S_3$. Thus, finer spray control is provided by adding additional set points along the dampening curve 404. Of course, if desired even more set points could be provided on the dampening curve to permit even finer spray control.

Figure 16:
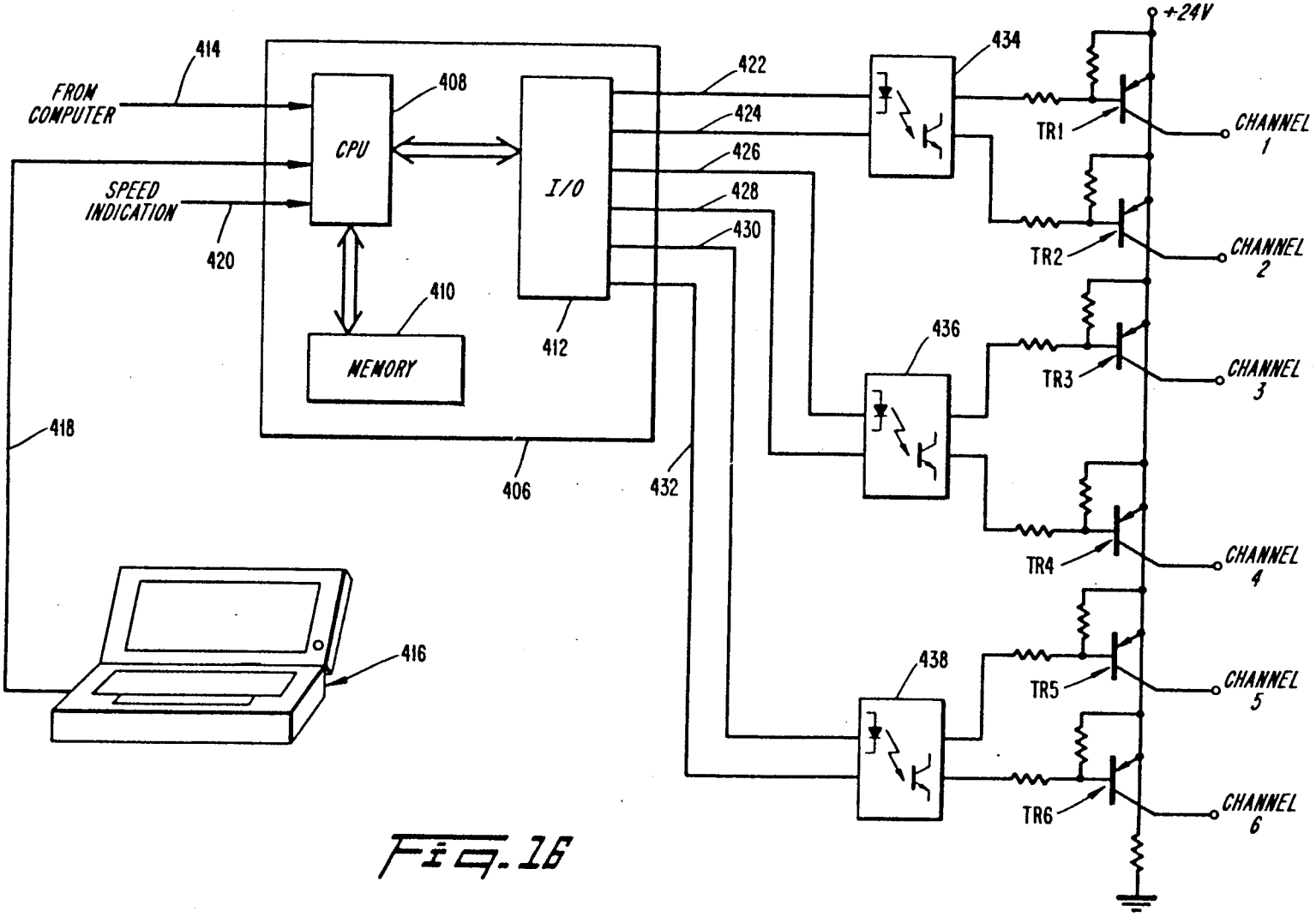
FIG. 16 is a schematic drawing of one embodiment of a spray dampener control system in accordance with the present invention.

Turning now to FIG. 16, a control system in accordance with the present invention includes a main controller 406 including a central processing unit (CPU) 408, a system memory 410, and an input/output (I/0) device 412. Additionally, a display device (not shown) such as a liquid crystal display, a light emitting diode (LED) display, or a cathode ray tube (CRT) may be provided to permit information concerning operating parameters and the like to be conveyed to a user. The system memory 410 preferably includes a non-volatile memory portion for storing one or more dampening curves.

Dampening curves may be preprogrammed into the system memory 410 or, preferably, the dampening curves may be downloaded from a computer or from a terminal device. For this purpose, a serial communications line 414 is provided to permit the controller 406 to communicate with a computer. Additionally, a terminal device 416 may communicate with the controller 406 through a communication line 418. Thus, the characteristics of the dampening curve, which will usually vary between presses, may be tailored to the particular application in which the spray dampener is used.

In operation, if the dampening curve information is stored in a computer, this information may be downloaded to the controller 406 through an appropriate serial interface, such as a standard RS 422 interface. This information may be supplied to CPU 408 for storage in the system memory 410. Preferably, for this purpose, the system memory 410 includes a programmable read-only memory device (PROM). Alternatively, the dampening curve information may be supplied to the CPU 408 from a terminal device 416. Thus, if desired a user can directly store an appropriate dampening curve in the system memory 410.

The CPU 408 is adapted to receive a press speed indication signal on an input line 420. The press speed indication signal may be obtained from a Hall effect proximity sensor or other appropriate sensor. Additionally, in modern printing presses which include a printing computer, a press speed indication signal might already be available in the press computer. In this case, the press speed indication signal may be obtained directly from the printing computer.

The CPU 408, in response to the speed indication signal, retrieves a record from the system memory 410 which contains information relating to the parameters of a spray nozzle actuation control signal. For instance, the speed indication signal might be converted into a memory address value. The contents stored in the system memory 410 at this address might then provide information indicating a duty cycle value for the spray nozzle actuation control signal. Based upon the stored duty cycle value and the speed indication signal, the parameters of the spray nozzle actuation signal may be calculated by the CPU 408.

For example, referring again to FIG. 15, if a speed-indication signal indicating a speed $S_4$ is obtained by the main controller 406, a record stored in system memory 410 in the appropriate memory location would including a duty cycle value 0.15 corresponding to 15% dampening. Since speed $S_4$ is lower than speed $S_2$, the pulse width $t_{ON}$ is set at a fixed value such as 20 microseconds. As discussed above, the duty cycle D may be expressed as $D=t_{ON}/(t_{ON}+t_{OFF})$, Solving for $t_{OFF}$, we obtain $t_{OFF}=t_{ON}*(1-D)/D$. Thus, $t_{OFF}=20*(1-0.15)/0.15=113$ microseconds. If a particular press speed value called for 6% dampening, $t_{OFF}$ would be 313 microseconds.

The pulse sequence parameters may similarly be calculated when the press speed value obtained by the main controller 406 is greater than speed $S_2$. For example, for press speed $S_5$, the appropriate memory location in system memory 410 would contain a record including a duty cycle value 0.22. Using a fixed time period of 400 microseconds between pulses, the pulse width value $t_{ON}$ may be determined by solving the expression $t_{ON}=-t_{OFF}*(1-D))$. Thus, $t_{ON}$ for speed $S_5$ would be $t_{ON}=400*(0.22/(1-0.22))=113$ microseconds.

When a press speed value corresponds to speed $S_2$, i.e., the speed value at which the pulse sequence changes from using a fixed pulse width to using a fixed time period between adjacent pulses, the main controller 406 may calculate either the pulse width $t_{ON}$ or the time period $t_{OFF}$.

Turning back to FIG. 16, once the CPU 408 has determined the parameters of the spray nozzle actuating pulse sequence, the I/0 unit 412 is controlled to output pulse sequences to the spray bar. In a preferred manner of forming the pulse sequence from the pulse parameters, the CPU 408 utilizes count values corresponding to the pulse width and the time period between pulses. If the pulse width count value is designated $C_{ON}$ and the count value corresponding to the time period between pulses is designed $C_{OFF}$, the CPU 408 may generate a rectangular pulse sequence by providing a HIGH output signal for $C_{ON}$ clock cycles and a LOW output signal for $C_{OFF}$ clock cycles. Count values $C_{ON}$ and $C_{OFF}$ may themselves be stored in system memory 410 for retrieval by the CPU 408 in response to the press speed indication signal.

Preferably the CPU 408 produces pulse sequences one through six which are output by I/0 unit 412 on first through sixth output lines 422, 424, 426, 428, 430 and 432, respectively. Output lines 422 and 424 are connected with the respective channels of a standard dual channel optocoupler 434. Similarly, output lines 426 and 428 are connected with the respective channels of a dual channel optocoupler 436, and output lines 430 and 432 are connected with respective channels of a dual channel optocoupler 438. The optocouplers serve to help isolate the main controller 406 from possible damage caused by transient surges and the like.

Output line 422, after passing through opto-coupler 434, controls the operation of a power transistor TR1. Similarly, output line 424 controls the operation of power transistor TR2; output line 426 controls the operation of power transistor TR3; output line 428 controls the operation of power transistor TR4; output line 430 controls the operation of power transistor TR5; and output line 432 controls the operation of power transistor TR6. Thus, the pulse sequences appearing on output lines 422–432 determine the operating states of power transistors TR1–TR6, respectively. In turn, the operating states of transistors TR1–TR6 determine the signals appearing on control channels 1–6, respectively.

Figure 17:
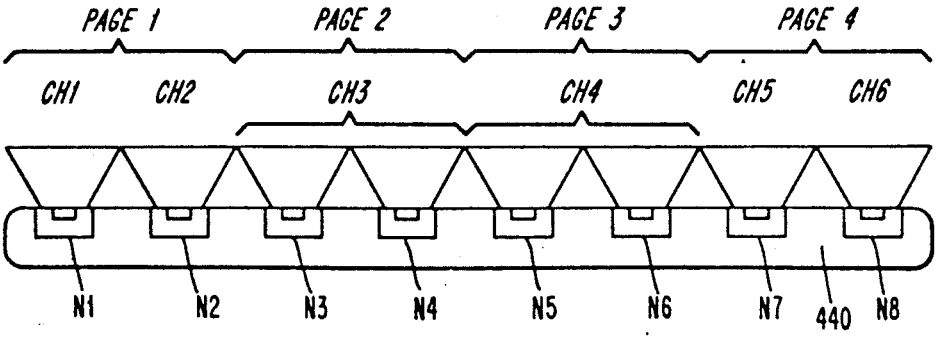
FIG. 17 illustrates the relationships between spray nozzles, control channels, and printed pages in accordance with one feature of the present invention.

Referring to FIG. 17, spray bar 440 may be provided with eight spray nozzles N1–N8 arranged in a linear array. Spray bar 440 is preferably adapted to supply dampening fluid for a multipage printing press. Typically, for example, the spray bar 440 provides dampening fluid for a four page printing press. In such a case, nozzles N1 and N2 primarily control dampening of page 1, nozzles N3 and N4 primarily control dampening of page 2, nozzles N5 and N6 primarily control dampening of page 3, and nozzles N7 and N8 primarily control dampening of page 4. Of course, the spray patterns from adjacent nozzles overlap slightly.

Since end nozzles N1 and N8 are situated at the outermost portions of the linear array of nozzles, there is no dampening contribution from overlapping spray from an adjacent outer nozzle. Thus, the portions of the dampening roller adjacent the outer portions of pages 1 and 4 receive somewhat less dampening fluid than the remaining portions of the roller. The outer portions of the roller, however, often have a greater tendency to heat than the intermediate portions of the roller. Accordingly, the portion of the roller which requires the greatest amount of dampening fluid often receives the least. It has been suggested that this problem may be overcome by using larger spray nozzles on the outer portions of the spray bar. This solution, however, often leads to additional problems associated with the use of differing spray nozzles on the spray bar. Additionally, maintenance and manufacture of the spray bars is complicated by this structure.

According to one feature of the present invention, this shortcoming of prior spray dampening systems has been overcome. As indicated in FIG. 17, nozzle N1 is controlled by channel 1; nozzle N2 is controlled by channel 2; nozzles N3 and N4 are controlled by channel 3; nozzles N5 and N6 are controlled by channel 4; nozzle N7 is controlled by channel 5; and nozzle N8 is controlled by channel 6. In order to compensate for increased heat and reduced dampening at the outer spray nozzles, the duty cycle of the pulse sequences on control channels 1 and 6 may be increased. For example, the duty cycle of the pulse sequence on control channel 1 may be slightly higher than the duty cycle of the pulse sequence on control channel 2. Similarly, the duty cycle of the pulse sequence on control channel 8 may be slightly higher than the duty cycle of the pulse sequence on control channel 7.

Preferably the duty cycle of the pulse sequences on control channels 1 and 8 are functionally related to the duty cycle of the pulse sequences on control channels 2 and 7, respectively. In an exemplary embodiment, the duty cycles of the pulse sequences on control channels 1 and 8 are 4% higher than the duty cycles of the pulse sequences on control channels 2 and 7, respectively. In other words, the duty cycle of nozzle N1 will be 1.04 times that of nozzle N2.

Since nozzles N1 and N8 each have a dedicated control channel, the different duty cycles may be accommodated. The CPU 408 may be programmed to calculate the modified duty cycle for nozzles N1 and N8 and adjust the pulse sequences on output lines 422 and 432 accordingly. Dedicated power transistors TR1 and TR8 control nozzles N1 and N8 in accordance with the modified pulse sequences.

Typically, in a multipage printing operation, the printing parameters will vary from the page to page. These variances in printing parameters may result in one page requiring additional (or less) dampening field. Accordingly, each page is provided with a separate control channel. As illustrated in FIG. 17, nozzles N3 and N4 (page 2) are operated by channel 3. Nozzles N5 and N6 (page 3) are controlled by channel 4. Of course, since outer nozzles N1 and N8 have dedicated control channels, nozzles N2 and N7 also have individual control channels CH2 and CH5, respectively. Again, however, it is noted that the duty cycle of the pulse sequence on channel 1 preferably is functionally related to the duty cycle of the pulse sequence on channel 2, and the duty cycle of the pulse sequence on channel 8 preferably is functionally related to the duty cycle of the pulse sequence on channel 7.

In order to allow greater flexibility in controlling the operation of the spray dampening device, the operating characteristics of the main controller may be varied in accordance with user instructions. Accordingly, user commands may to input to the main controller 406 through terminal 416. Additionally, the main controller 406 may include keypad or specific control knobs (not shown). If, for example, page 2 required increased dampening, a user could instruct the CPU 408 to increase the duty cycle of the pulse sequence on channel 3.

Although the present invention has been described in connection with preferred embodiments thereof, it will be appreciated by those skilled in the art that additions, deletions, modifications and substitutions not specifically described may be made without departing from the spirit and scope of the invention as defined in the appended claims.

What is claimed is:

1. A control system for operating a spray dampening system having a plurality of spray nozzles for supplying dampening fluid to a roller of a printing press, comprising:

means for obtaining a speed signal representative of a printing speed of said printing press;

means for producing a first rectangular pulse sequence such that when the value of said speed signal is below a first speed value each rectangular pulse in said first pulse sequence has a fixed duration and the time period between adjacent pulses is varied in response to said speed signal, and when the value of said speed signal is above said first speed value the time period between adjacent pulses in said first pulse sequence is fixed and the duration of the pulses is varied in response to said speed signal; and means for driving said nozzles in response to said first rectangular pulse sequence.

2. The system of claim 1, wherein said first rectangular pulse sequence comprises rectangular pulses of a first fixed duration when the value of said speed signal is below said first speed value and pulses of a second fixed duration when the value of said speed signal is below a lower second speed value.

3. The system of claim 2, wherein said spray dampening system includes at least four spray nozzles arranged in a linear array and providing overlapping spray patterns, wherein said driving means includes a separate drive channel for the outermost nozzle on each end of said linear array, respectively, and at least one drive channel for paired nozzles in an intermediate portion of said linear array.

4. The system of claim 3, wherein said pulse sequence producing means further produces a second rectangular pulse sequence for driving each of said outermost nozzles of said linear array, said second rectangular pulse sequence being related to said first rectangular pulse sequence such that the outermost nozzles have a higher duty cycle than the nozzles in the intermediate portion of said linear array.

5. The system of claim 2, wherein said first rectangular pulse sequence includes a first fixed time period between adjacent pulses of said rectangular pulse sequence when the value of said speed signal is above said first speed value and a second fixed time period between adjacent pulses when the value of said speed signal is above a higher third speed value.

6. The system of claim 5, wherein said spray dampening system includes at least four spray nozzles arranged in a linear array and providing overlapping spray patterns, wherein said driving means includes a separate drive channel for the outermost nozzle on each end of said linear array, respectively, and at least one drive channel for paired nozzles in an intermediate portion of said linear array.

7. The system of claim 6, wherein said pulse sequence producing means further produces a second rectangular pulse sequence for driving each of said outermost nozzles of said linear array, said second rectangular pulse sequence being related to said first rectangular pulse sequence such that the outermost nozzles have a higher duty cycle than the nozzles in the intermediate portion of said linear array.

8. The system of claim 1, wherein said spray dampening system includes at least four spray nozzles arranged in a linear array and providing overlapping spray patterns, wherein said driving means includes a separate drive channel for the outermost nozzle on each end of said linear array, respectively, and at least one drive channel for paired nozzles in an intermediate portion of said linear array.

9. The system of claim 8, wherein said pulse sequence producing means further produces a second rectangular pulse sequence for driving each of said outermost nozzles of said linear array, said second rectangular pulse sequence being related to said first rectangular pulse sequence such that the outermost nozzles have a higher duty cycle than the nozzles in the intermediate portion of said linear array.

10. The system of claim 1, wherein said first rectangular pulse sequence includes a first fixed time period between adjacent pulses of said rectangular pulse sequence when said press speed is above said first speed value and a second fixed time period between adjacent pulses when said press speed is above a higher second speed value.

11. The system of claim 10, wherein said spray dampening system includes at least four spray nozzles arranged in a linear array and providing overlapping spray patterns, wherein said driving means includes a separate drive channel for the outermost nozzle on each end of said linear array, respectively, and at least one drive channel for paired nozzles in an intermediate portion of said linear array.

12. The system of claim 11, wherein said pulse sequence producing means further produces a second rectangular pulse sequence for driving each of said outermost nozzles of said linear array, said second rectangular pulse sequence being related to said first rectangular pulse sequence such that the outermost nozzles have a higher duty cycle than the nozzles in the intermediate portion of said linear array.

13. A method for controlling the operation of a spray dampening system having a plurality of solenoidoperated spray nozzles for supplying dampening fluid to a roller of a printing press, comprising the steps of:

obtaining a signal representative of a printing speed of said printing press;

generating a first rectangular pulse sequence such that when said the speed of said printing press is below a first speed value each rectangular pulse in said first rectangular pulse sequence has a fixed duration and the time period between adjacent pulses is varied as a function of said speed signal, and when the speed of said printing press is above said first speed value the period between adjacent pulses in said first rectangular pulse sequence is fixed and the duration of the pulses is varied as a function of said speed signal; and driving said solenoids in response to said first rectangular pulse sequence.

14. The method of claim 13, wherein said generating step generates rectangular pulses having a first fixed duration when the speed of said printing press is below said first speed value and pulses of a second fixed duration when the speed of said printing press is below a lower second speed value.

15. The method of claim 14, wherein said generating step provides a first fixed time period between adjacent pulses of said rectangular pulse sequence when the speed of said printing press is above said first speed value and a second fixed time period between adjacent pulses when said press speed is above a higher third speed value.

16. The method of claim 13, wherein said generating step provides a first fixed time period between adjacent pulses of said rectangular pulse sequence when the speed of said printing press is above said first speed value and a second fixed time period between adjacent pulses when said press speed is above a higher second speed value.

17. The method of claim 13, wherein said spray dampening system includes at least four spray nozzles arranged in a linear array and providing overlapping spray patterns, further including the steps of generating a second rectangular pulse sequence for driving the outermost nozzle on each end of said linear array, said second rectangular pulse sequence being related to said first rectangular pulse sequence and having a higher duty cycle than said first rectangular pulse sequence, and driving said outermost nozzles in response to said second rectangular pulse sequence.

18. A spray dampening system for providing a dampening fluid to a moving surface, comprising:

means for sensing the speed of said moving surface and for providing a signal related to the sensed speed;

at least one spray bar including a linear array of spray nozzles arranged to provide overlapping spray patterns on said moving surface;

means operatively coupled with said sensing means for generating a first rectangular pulse sequence having a duty cycle which is related to the value of said signal provided by said speed sensing means, wherein when said sensed speed is below a first speed value each rectangular pulse in said first pulse sequence has a fixed duration and the time period between adjacent pulses is varied in response to said sensed speed signal and when said sensed speed is above said first speed value the time period between adjacent pulses in said first pulse sequence is fixed and the duration of the pulses is varied in response to said sensed speed signal; and means for driving said nozzles in accordance with said first rectangular pulse sequence.

19. The spray dampening of claim 18, wherein said generating means includes a central processing unit which, based upon said sensed speed signal, retrieves a record stored in a memory device, said record containing information for controlling at least one of the pulse width and the time period between adjacent pulses of said first rectangular pulse sequence, said central processing unit operating in response to said retrieved record to produce said first rectangular pulse sequence.

20. The spray dampening system of claim 19, wherein said record is a duty cycle value and, when said sensed speed is below said first speed value, the time period between adjacent pulses of said first rectangular pulse sequence is determined from said duty cycle value and said fixed duration, and, when said sensed speed is above said first speed value, the duration of said pulses in said first rectangular pulse sequence is determined from said duty cycle value and said fixed time period between adjacent pulses.

21. The spray dampening system of claim 18, wherein each of said spray nozzles is operated by a solenoid and said driving means includes a plurality of power transistors which operate said solenoids, and wherein said first rectangular pulse sequence controls operation of said power transistors.

22. The spray dampening system of claim 21, further comprising an opto-coupler connected between said pulse sequence generating means and each of said power transistors.

23. The spray dampening system of claim 21, wherein said at least one spray bar includes at least four spray nozzles, the outermost nozzle at one end of said linear array being operated by a first dedicated power transistor and the outermost nozzle at the other end of said linear array being operated by a second dedicated power transistor, and further including means for generating a second rectangular pulse sequence which is related to said first rectangular pulse sequence and has a higher duty cycle than said first rectangular pulse sequence, and means for generating a third rectangular pulse sequence which is related to said first rectangular pulse sequence and has a higher duty cycle than said first rectangular pulse sequence, said second rectangular pulse sequence operating said first dedicated power transistor. and said third rectangular pulse sequence operating said second dedicated power transistor.

24. A spray dampening system for providing a dampening fluid to a roller of a printing press, comprising:

a spray bar including first through eighth spray nozzles arranged in a linear array adjacent said roller and arranged to provide overlapping spray patterns on said rollers;

means for obtaining a speed-indication signal related to a speed of said printing press;

means responsive to said speed-indication signal for generating first through sixth pulse sequences each having a duty cycle which is related to the value of said speed-indication signal, the duty cycle of said first pulse sequence being higher than the duty cycle of said second pulse sequence, and the duty cycle of said sixth pulse sequence being higher than the duty cycle of said fifth pulse sequence, each of said pulse sequences being such that when said printing press speed is below a first speed value each pulse in each of said first through sixth pulse sequences is fixed at first through sixth durations, respectively, and the time period between adjacent pulses of the respective pulse sequences is varied in response to said speed-indication signal, and when said printing press speed is above said first speed value the time period between adjacent pulses of each of said first through sixth pulse sequences is fixed at first through sixth time period values, respectively, and the duration of the pulses of the respective pulse sequences is varied in response to said speed-indication signal; and means for driving said spray nozzles, said driving means including a first channel responsive to said first pulse sequence for driving said first spray nozzle, a second channel responsive to said second pulse sequence for driving said second spray nozzle, a third channel responsive to said third pulse sequence for driving said third and fourth spray nozzles, a fourth channel responsive to said fourth pulse sequence for driving said fifth and sixth spray nozzles, a fifth channel responsive to said fifth pulse sequence for driving said seventh spray nozzle, and sixth channel responsive to said sixth pulse sequence for driving said eighth spray nozzle.

25. The spray dampening system of claim 24 wherein the duty cycle of said first pulse sequence is functionally related to the duty cycle of said second pulse sequence, and wherein the duty cycle of said sixth pulse sequence is functionally related to the duty cycle of said fifth pulse sequence.

26. The spray dampening system of claim 24, wherein said generating means includes a central processing unit which, based upon said speed-indication signal, retrieves a record stored in a memory device, said record containing information for controlling at least one of the pulse width and the time period between adjacent pulses of said pulse sequences, said central processing unit operating in response to said retrieved record to produce said pulse sequences.

27. The spray dampening system of claim 26, wherein said record is a duty cycle value and, when said printing press speed is below said first speed value, the time periods between adjacent pulses of said pulse sequences are determined from said duty cycle value and said fixed durations and, when said printing press speed is above said first speed value, the durations of said pulses in said pulse sequences are determined from said duty cycle value and said fixed time periods between adjacent pulses.

28. The spray dampening system of claim 27, further including means for receiving user input control signals, said user input control signals being operative to selectively vary the duty cycle of one or more of said first through sixth pulse sequences.

29. The spray dampening system of claim 24, further including means for receiving user input control signals, said user input control signals being operative to selectively vary the duty cycle of one or more of said first through sixth pulse sequences.

* * * * *